US006423409B2

(12) United States Patent
Swers et al.

(10) Patent No.: US 6,423,409 B2
(45) **Date of Patent: *Jul. 23, 2002**

(54) SELF-COATING COMPOSITE STABILIZING YARN

(75) Inventors: David N. Swers, Chapel Hill, NC (US); Johnny E. Parrish, Anderson, SC (US)

(73) Assignee: Glen Raven, Inc., Glen Raven, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/867,943

(22) Filed: May 30, 2001

Related U.S. Application Data

(63) Continuation-in-part of application No. 09/659,324, filed on Sep. 12, 2000, now abandoned, which is a continuation of application No. 09/216,516, filed on Dec. 18, 1998, now Pat. No. 6,117,548.

(51) Int. Cl.[7] ..... D01F 3/00

(52) U.S. Cl. ..... 428/370; 428/395; 139/383 R; 139/420 R

(58) Field of Search ..... 428/370, 395, 428/373; 139/383 R, 420 R

(56) References Cited

U.S. PATENT DOCUMENTS

| | | | | | |
|---|---|---|---|---|---|
| 4,080,777 | A | * | 3/1978 | Griset, Jr. | 57/140 |
| 4,160,057 | A | | 7/1979 | Kogan et al. | 428/245 |
| 4,212,152 | A | * | 7/1980 | Roman | 57/207 |
| 4,276,348 | A | | 6/1981 | Wu et al. | 428/373 |
| 4,406,310 | A | * | 9/1983 | Reader et al. | 139/420 R |
| 4,430,852 | A | * | 2/1984 | Hatcher | 57/247 |
| 4,534,164 | A | | 8/1985 | Toshimasa et al. | 57/290 |
| 4,830,907 | A | | 5/1989 | Sawyer e tal. | 428/225 |
| 4,839,228 | A | | 6/1989 | Jezic et al. | 428/401 |
| 5,104,703 | A | | 4/1992 | Rachman et al. | 428/35.6 |
| 5,187,005 | A | | 2/1993 | Stahle et al. | 428/252 |
| 5,190,809 | A | | 3/1993 | Marissen et al. | 428/225 |
| 5,192,601 | A | | 3/1993 | Neisler | 428/120 |
| 5,199,141 | A | | 4/1993 | Trask et al. | 28/115 |
| 5,271,992 | A | | 12/1993 | Siener, Jr. et al. | 428/204 |
| 5,284,704 | A | | 2/1994 | Kochesky et al. | 428/296 |
| 5,305,813 | A | | 4/1994 | Poole | 160/236 |
| 5,397,622 | A | | 3/1995 | Thomas | 428/192 |
| 5,617,903 | A | | 4/1997 | Bowen, Jr. | 139/383 A |
| 5,698,480 | A | | 12/1997 | Geiman et al. | 442/181 |
| 5,712,209 | A | | 1/1998 | Geiman et al. | 442/208 |
| 6,117,548 | A | * | 9/2000 | Swer et al. | 428/370 |

FOREIGN PATENT DOCUMENTS

| | | | |
|---|---|---|---|
| EP | 629724 | 11/1995 | |
| EP | 816544 | 2/1998 | D03D/15/00 |

* cited by examiner

*Primary Examiner*—N Edwards
(74) *Attorney, Agent, or Firm*—Womble Carlyle Sandridge & Rice, PLLC

(57) ABSTRACT

A self-coating stabilizing yarn for use with conventional effect yarns in the construction of outdoor fabrics. The self-coating yarn includes a low melt constituent and a high melt constituent. After being woven with the effect yarns and exposed to a preselected heating temperature, the low melt constituent melts, flows through the fibers or filaments of the stabilizing yarns and onto the adjacent effect yarn, thus forming bonds and stabilizing and strengthening both the stabilizing yarns, the effect yarns, and the resulting fabric.

20 Claims, 1 Drawing Sheet

SELF-COATING COMPOSITE STABILIZING YARN

REFERENCE TO RELATED APPLICATION

This application is a continuation-in-part of U.S. application Ser. No. 09/659,324 filed Sep. 12, 2000, now abandoned which is a continuation of U.S. application Ser. No. 09/216,516 filed Dec. 18, 1998, which issued into U.S. Pat. No. 6,117,548 on Sep. 12, 2000.

FIELD OF THE INVENTION

The present invention relates to yarns used for outdoor fabrics. More particularly, the invention relates to a blended or composite self-coating yarn which, when combined with other effect yarns, is capable of stabilizing and strengthening such fabrics without the use of a latex back coating or other topical treatments.

BACKGROUND OF THE INVENTION

Blended or composite yarns formed of high melt and low melt fibers or filaments are generally known for various applications. Examples of such yarns are described in U.S. Pat. Nos. 5,651,168; 5,397,622; and 5,536,551. None of the above yarns, however, are appropriate for or intended for use as a stabilizing yarn for outdoor applications requiring a high degree of dimensional stability, and strength. The term "outdoor fabrics" as used herein is defined as fabric for awnings, tents, sling fabric for furniture, cushions, umbrellas, marine applications, convertible tops, and the like. The term "effect yarn" is intended to mean yarns, such as acrylics, polyester, and polypropylene, which are used in the construction of aesthetically appealing, softer blend decorative fabrics.

Many yarns are inappropriate for outdoor use unless they are solution dyed and UV stable. Such yarns that are appropriate include acrylics, high melt polyester, nylon, and high melt polypropylene. The aforementioned yarns are not considered to be particularly dimensionally stable nor resistant to abrasion in open weave structures. As a result, in such applications the fabric is either provided with a latex backing to improve stability or it is used with the recognized deficiencies.

Thus, there is a need for a stabilizing yarn suitable for use with effect yarns in the fabrication of open weave fabrics to be utilized in outdoor applications wherein such fabrics will be imparted with improved abrasion resistance, weave stability, strength and the other characteristics described hereinabove.

Use of a latex backing is a recognized impediment to the use and acceptance of fabrics in outdoor applications. The application of a latex backing is expensive, requiring specialized machinery, additional chemical cost and, at times, slower tenter speeds or multiple passes through the tentering operation. It also provides a greater opportunity for mildew problems and renders a stiffer fabric with only one side available for decorative patterning.

SUMMARY OF THE INVENTION

The present invention, therefore, is directed to a novel composite or blended stabilizing yarn intended for use with effect yarns to fabricate an open weave fabric structure, or, when used in more tightly woven fabrics results in a fabric appearing and feeling to be heavier than it actually is. Outdoor fabrics, which include as a component the yarns of the present invention, achieve strength and dimensional stability without being heavy and/or tightly woven. By use of the novel stabilizing yarn of the present inventbn, a better hand is imparted and the resulting fabrics are made to "feel" heavier than they actually are. The stabilizing yarn includes a binder constituent which may be a filamentary constituent of a composite yarn or a staple fiber constituent of a blended yarn. The yarn is used with effect yams in a woven fabric. The binder constituent is then released during the tentering operation and provides the resulting fabric with superior weave stability, abrasion resistance and esthetic characteristics or properties without the need for latex back coatings. Wicking capability is another important characteristic for quick drying after exposure to water or other liquids.

The yarn of the present invention, therefore, is a self-coating composite stabilizing yarn having one or more low melt constituent and one or more high melt constituent. The low and high melt constituents are intermingled in one of several yarn forming operations to provide a composite or blended yarn having a denier in the range of 400 to 4,000 or equivalent yarn count. By "low melt" the present invention envisions a constituent having a melt temperature in the range of 240° F. and 300° F. On the other hand, the "high melt" constituent is intended to be defined by a fiber or filament having a melt temperature of 280° F.–340° F. or even greater. Also, in any composite or blended yarn, the high melt constituent should have a melt temperature of at least 40–600° F. above that of the low melt constituent. The composite or compounded yarn may be formed in various ways. In one way a continuous filament low melt yarn can be combined with one or more ends of a continuous filament high melt effect yarn with the filament ends being combined during a texturing operation, such as air jet texturing, false twist texturing, twisting, prior twisting, conventional covering and the like. In a second approach, low melt and high melt staple fibers may be homogeneously mixed or blended, then processed according to standard staple yarn processing techniques.

The resulting yarn becomes self-coating and self-bonding in that the low melt constituent or component melts during a subsequent heat operation after fabric formation. Melted polymer then flows through the adjacent fibers or filaments and onto the adjacent effect yarns to bind the individual fabric components. This makes for a stronger fabric. Further, the individual fabric yarns are fixed in place and thereby the fabric structure is stabilized. The melting of the low melt constituent minimizes raveling, and seam slippage, imparts greater load elongation recovery, and greater abrasion resistance, and all without the application of a conventional latex backing. Since the latex backing can be eliminated, the resulting fabric is more esthetically acceptable with the color pattern of the yarns being visible on both sides of the fabric. In a continuous lay down operation for pattern cutting, the fabric is folded exposing alternate sides in the finished product, and therefore the latex backing will not permit this technique.

These and other aspects of the present invention will become apparent to those skilled in the art after reading of the following description of the preferred embodiments when considered in conjunction with the drawings. It should be understood that both the foregoing general description and the following detailed description are exemplary and explanatory only and are not restrictive of the invention as claimed. The accompanying drawings, which are incorporated in and constitute a part of the specification, illustrate two embodiments of the invention and, together with the description, serve to explain the principles of the invention.

BRIEF DESCRIPTION OF THE DRAWINGS

The above and other objects, features, and advantages of the present invention will become more apparent and will be more readily appreciated from the following detailed description of the preferred embodiments of the invention taken in conjunction with the accompanying drawings, in which.

DESCRIPTION OF THE PREFERRED EMBODIMENTS

Figure 2:
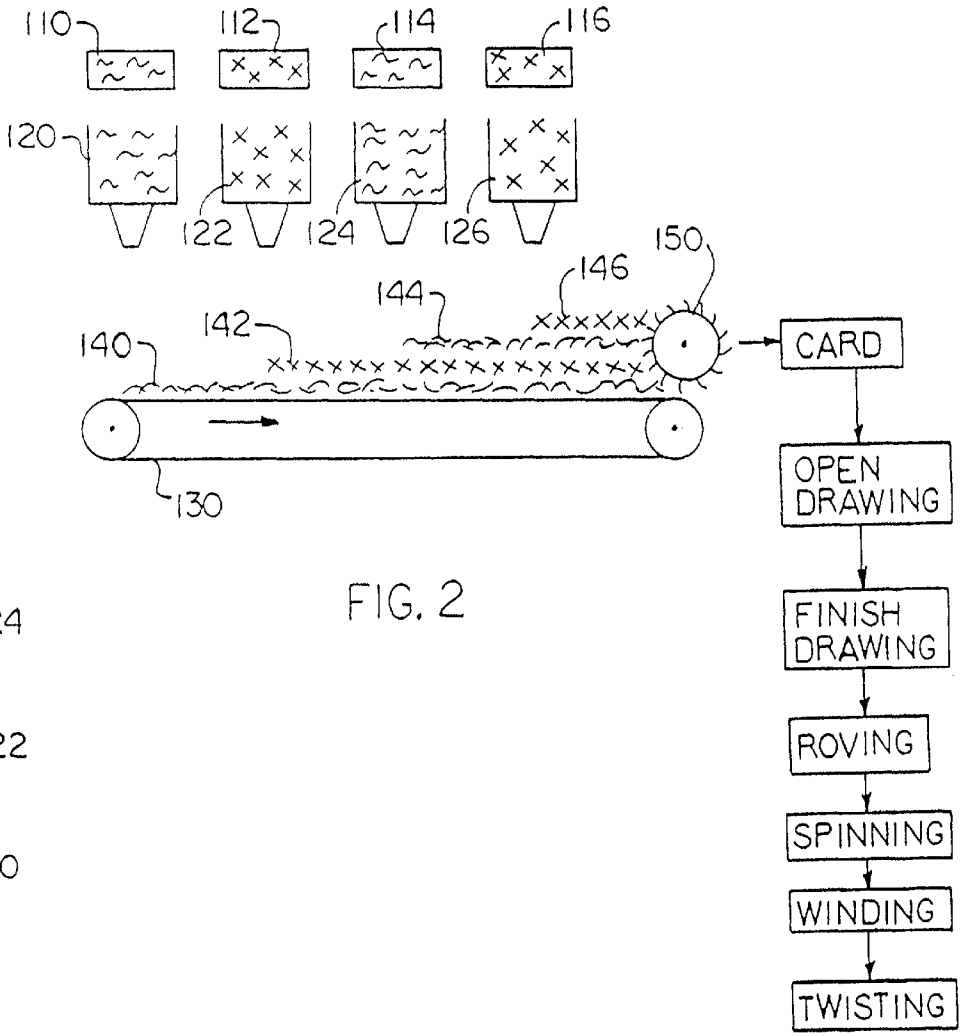
FIG. 2 is an illustration in which low melt and high melt fibers are blended, then processed according to standard processing to form a blended yarn.
Figure 1:
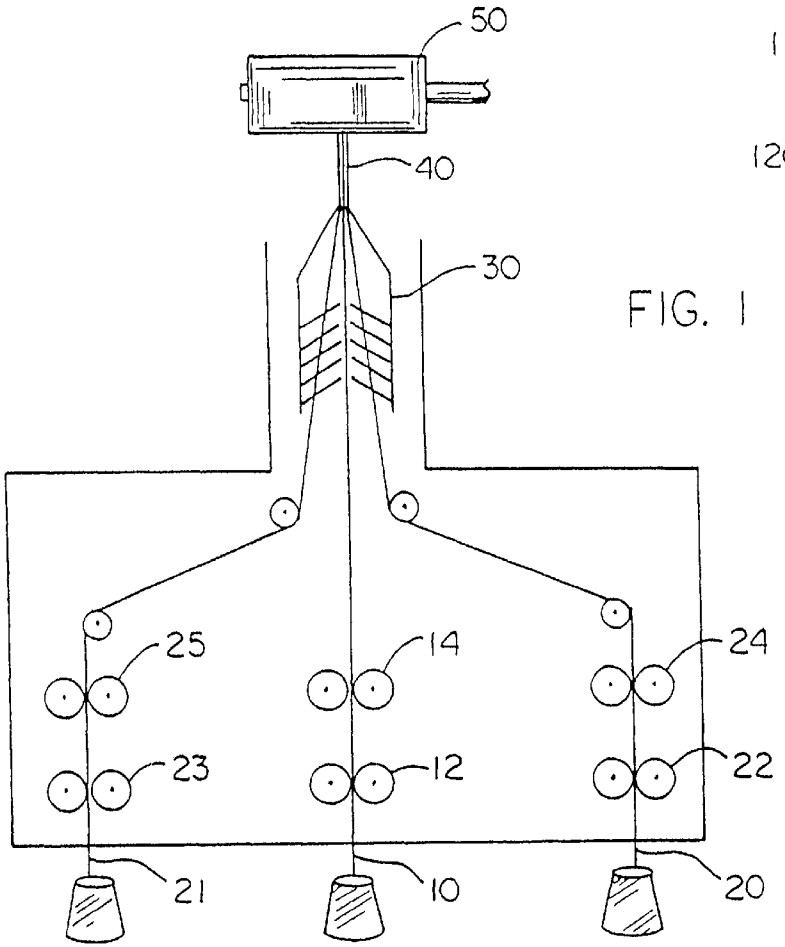
FIG. 1 is a representation of the processing of a composite yarn in which a continuous filament core is delivered with one or more continuous effect filaments and subjected to an air texturing operation.

The self-coating composite yarn of the present invention may be formed in accordance with FIG. 1 or FIG. 2. In general, such composite yarns include both low melt and high melt constituents. The term "low melt" constituent is intended to mean fibers or filaments having a melt temperature below the temperature of the eventual tentering operation and generally in the range of 240–300° F. The term "high melt" constituent is intended to mean fibers or filaments having a melt temperature at least 40° F.–60° F. higher than the melt temperature of the low melt constituent with which it is intended to be used. Thus, if the ensuing tentering operation is about 290° F., melt temperature of the low melt constituent may be selected at 260° F., and the high melt constituent should be selected to have a melt temperature of about 310°.

Further, the high melt effect yarn is preferably either acrylic, high melt polyester, high melt polypropylene, or nylon while the low melt yarn is preferably polyethylene, low melt polyester or low melt polypropylene. The composite yarn with which the present invention is intended includes deniers in the range of 400–4,000 or equivalent yarn counts. By incorporating the self-coating aspect accomplished by use of the low melt constituent, composite yarn itself and the resulting fabric realizes minimal or zero raveling.

Examples of uses of various denier, by way of example include:

400 d—open weave, light weight fabrics, i.e. for cushions and shade fabrics 1200 d—heavier fabrics such as sling fabric 2400 d—even heavier fabrics such as for industrial uses or heavier slings 3700 d—heaviest fabrics also for industrial uses Further, the resulting yarn is extremely abrasion resistant and will meet standards of up to 9,000 double rubs. Such yarns create a fabric that is extremely resistant to slippage. By slippage resistant, it is meant that fabrics formed from such yarns when subjected to an Instron slippage test exhibit an increase from about 20 lbs. in the case of conventionally known fabrics to 40 lbs., and in some instances, even greater than 60 lbs. Also such fabrics formed with the yarns of the present invention will have an increase in load recovery from about 80%, as in the case of conventional fabrics, to 95% and better in the case of fabrics formed with the yarns of the present invention.

EXAMPLE 1

One way of producing a yarn in accordance with a first embodiment of the invention is illustrated in FIG. 1. One end 10 of a continuous filament low melt yarn, such as polyethylene passes between draw rollers 12, 14 and is introduced into an air texturing zone 30. Yarn 10 is drawn between rollers 12 and 14 at a 3 to 1 ratio. The denier of yarn 10 is, by way of example, selected to be 750, and therefore enters the air texturing zone as a filament having a denier of 250.

Two high melt yarns, 20, 21 are drawn from separate packages. Yarn 20 is passed between draw rollers 22, 24, while yarn 21 is drawn between rollers 23, 25. The yarns 20, 21 are drawn at a 1.65 to 1 ratio from an initial denier in the range of 250–5,700 to a final denier in the range of 150 to 3,500. Resulting compound or composite yarn ranges from a denier of 400 to 4,000. The low melt yarn 10 is selected from the group consisting of polyethylene, low melt polypropylene, low melt polyester and other olefins, whereas the high melt yarn is selected from the group consisting of acrylic, polyester, high melt polypropylene and nylon. Other texturing techniques may be utilized though an air texturing process as described hereinabove.

Other examples of air textured filamentary yarns include:

EXAMPLE 2

One end of 250 denier polyethylene filament yarn is air textured with one end of 300 denier high melt filament polypropylene to form a 625 denier stabilizing yarn. Two ends of each may be air textured to provide a 1300 denier stabilizing yarn.

EXAMPLE 3

One end of 250 denier polyethylene filament yarn is air textured with one end of 300 denier filament polyester to form a 625 denier stabilizing yarn. Two ends of each may be air textured to provide a 1300 denier stabilizing yarn.

EXAMPLE 4

An end of 18/2 acrylic yarn is air textured with two ends of 250 denier polyethylene to form a stabilizing yarn. Alternatively, an end of 8/1 acrylic yarn may be air textured with two ends of 250 denier polyethylene.

EXAMPLE 5

Two ends of 250 denier polyethylene filament yarn are air textured with two ends of 1000 denier polyester to form a 2800 denier stabilizing yarn.

Other examples of blended yarns include:

EXAMPLE 6

Turning now to a second embodiment, as illustrated in FIG. 2 bales 110, 112, 114, and 116. The bales deliver staple fiber into weigh hoppers 120, 122, 124, and 126 and weigh pans 121, 123, 125, and 127 therebelow. The weigh pans 121, 123, 125, and 127 deliver measured amounts of staple fiber onto a conveyer belt 130 in layers 140, 142, 144, and 146. Finally, the layers are delivered to a card 150 at the end of the conveyer belt where the fibers are homogeneously mixed and aligned during the carding operation. The subsequent conventional processing by drawing, roving, ring spinning, winding, and twisting produce the final compounded yarn.

In order to produce a typical blend of 90% acrylic 10% polyethylene, staple fibers are removed from bales 110, 112, 114, and 116. Each bale will contain one type of fiber. For example, bale 110 would include solution dyed acrylic, bale 112 polyethylene, bale 114 solution dyed acrylic, and bale 116 polyethylene. By use of weigh pans 121, 123, 125 and 127, measured amounts of acrylic and polyethylene would be deposited onto a conveyor. For example, weigh pans 121 and 123 would be initially set to deliver nine parts of acrylic for each one part of polyethylene. Depending upon the results actually achieved in the initial weighing, weigh pans 125 and 127 could be adjusted to provide a blended sandwich of 90% acrylic and 10% ethylene by weight.

While one technique for producing staple yarn has been illustrated, it is apparent that other techniques are available.

EXAMPLE 7

A blend of 95% acrylic staple/5% low melt polyester staple is produced in the manner described in Example 6. In this example weigh pans 121 and 123 would be set to deliver 19 parts of acrylic for each one part of low melt polyester delivered by weight pans 125 and 127. Obviously, bales 112 and 116 would include the low melt polyester.

EXAMPLE 8

A blend of 90% acrylic staple/10% low melt polyester staple is produced in the manner described in Example 7, except weigh pans 121 and 123 would deliver nine parts of acrylic for each one part of low melt polyester delivered by weight pans 125 and 127.

EXAMPLE 9

A blend of 90% acrylic staple/10% low melt polypropylene staple is produced in the manner described in Example 8, except bales 112 and 116 carry the low melt polypropylene.

EXAMPLE 10

A blend of 85% solution dyed acrylic staple/15% low melt polypropylene staple is produced in the manner described in Example 9, except weigh pans 121 and 123 would be set to deliver 17 parts of acrylic for each 3 parts of low melt polypropylene.

What is claimed is:

1. A self-coating composite yarn for outdoor fabrics comprising:

a. a polymeric high melt effect constituent having a melt temperature of at least 280° F., said high melt constituent being selected from the group consisting of acrylic, high melt polyester, high melt polypropylene and nylon;

b. a polymeric low melt binder constituent having a melt temperature no greater than 300° F., said low melt constituent being selected from the group consisting of polyethylene low melt polyester, and low melt polypropylene;

c. the difference between the low melt constituent and the high melt constituent being at least 40° F.;

d. the high melt and low melt constituents being intermingled to form the composite yarn;

e. the composite yarn having a denier of 400–4,000;

f. when the composite yarn is subjected to heat, the composite yarn becomes self-coating and self-bonding.

2. The self-coating composite stabilizing yarn according to claim 1 wherein the denier of the low melt constituent prior to the intermingling step is about 250 d and the high melt constituent is in the range of 150 d–3,500 d.

3. The self-coating composite stabilizing yarn according to claim 1 having minimal or zero raveling.

4. The self-coating composite stabilizing yarn according to claim 1 wherein the low melt constituent comprises at least one end of continuous filament low melt yarn, and the high melt constituent comprises at least one end of continuous filament high melt yarn, the low melt and high melt yarns being air textured.

5. The self-coating composite stabilizing yarn according to claim 4 wherein the low melt yarn is 750 denier drawn at a 3–1 ratio to 250 denier and each high melt yarn is initially 250 denier-5,700 denier drawn at a ratio of 1.65–1 to a denier in the range of 150–3,500.

6. The self-coating composite stabilizing yarn according to claim 5 wherein the composite yarn has a composite denier in the range of 400–4,000 d.

7. The self-coating composite stabilizing yarn according to claim 1 comprising a blend of low melt and high melt staple fibers homogeneously mixed and processed according to conventional blended yarn forming procedures.

8. The self-coating composite stabilizing yarn according to claim 7 wherein the low melt and high melt staple fibers comprise polyethylene binder fibers and acrylic high melt effect fibers respectively.

9. The self-coating composite stabilizing yarn according to claim 7 wherein the ratio of high melt effect fibers to low melt binder fibers is approximately 10–1.

10. The self-coating composite stabilizing yarn according to claim 7 wherein the low melt fibers are low melt polyester and the high melt fibers are acrylic.

11. The self-coating composite stabilizing yarn according to claim 7 wherein the low melt fibers are low melt polypropylene and the high melt fibers are acrylic.

12. The self-coating composite stabilizing yarn according to claim 7 wherein the homogeneously mixed staple fibers are sufficiently strong before heat setting to withstand high speed carding, spinning, winding and twisting.

13. The self-coating composite stabilizing yarn according to claim 7 wherein the final product has a denier in the range of 400–4,000 d.

14. The self-coating composite stabilizing yarn according to claim 4 wherein the low melt yarn comprises one end of 250 denier polyethylene filament yarn air textured with one end of 300 denier high melt filament polypropylene.

15. The self-coating composite stabilizing yarn according to claim 14 wherein two ends of each are air textured for a 1300 denier stabilizing yarn.

16. The self-coating composite stabilizing yarn according to claim 4 wherein the low melt yarn comprises one end of 250 denier polyethylene filament yarn and said high melt yarn is one end of 300 denier filament polyester.

17. The self-coating composite stabilizing yarn according to claim 16 wherein two ends of each are air textured for a 1300 denier stabilizing yarn.

18. The self-coating composite stabilizing yarn according to claim 4 wherein the high melt yarn comprises one end of 18/2 blended acrylic yarn and the low melt yarn is two ends of 250 denier polyethylene.

19. The self-coating composite stabilizing yarn according to claim 18 wherein one end of 8/1 acrylic yarn may be air textured with two ends of 250 denier polyethylene.

20. The self-coating composite stabilizing yarn according to claim 4 wherein the low melt yarn comprises two ends of 250 denier polyethylene filament yarn and the high melt yarn is two ends of 1000 denier polyester.

* * * * *